United States Patent [19]

Firey

[11] Patent Number: 4,568,265

[45] Date of Patent: Feb. 4, 1986

[54] CROSSED PULSE BURNER ATOMIZER

[76] Inventor: Joseph C. Firey, P.O. Box 15514, Seattle, Wash. 98115-0514

[21] Appl. No.: 675,932

[22] Filed: Nov. 28, 1984

Related U.S. Application Data

[63] Continuation-in-part of Ser. No. 425,122, Sep. 27, 1982, Pat. No. 4,508,273.

[51] Int. Cl.[4] ..... F23C 11/04

[52] U.S. Cl. ..... 431/1; 123/26; 123/533; 123/585; 239/70; 239/95; 239/99

[58] Field of Search ..... 431/1; 239/101, 102, 239/433, 426, 70, 95, 99; 123/26, 533, 585

[56] References Cited

U.S. PATENT DOCUMENTS

| | | | |
|---|---|---|---|
| 966,704 | 8/1910 | Pickles | 239/433 |
| 2,591,401 | 4/1952 | Camner | 239/90 |
| 2,697,007 | 12/1954 | Wille | 239/95 |
| 3,650,261 | 3/1972 | Hotsell | 123/26 |
| 4,465,050 | 8/1984 | Igashira et al. | 123/585 |

*Primary Examiner*—Carroll B. Dority, Jr.

[57] ABSTRACT

A liquid fuel atomizer is described which creates liquid pulses and gas pulses which are directed and timed to impact each other. The forces created during impact atomize the liquid fuel into droplets. Large and repeated atomizing forces can be thusly applied yielding fine atomization of even very high viscosity liquids. Applications of crossed pulse liquid atomizers to liquid fuel burner combustion systems are described.

11 Claims, 14 Drawing Figures

CROSSED PULSE BURNER ATOMIZER

CROSS REFERENCES TO RELATED APPLICATIONS

This application is a continuation-in-part of my earlier filed U.S. patent application entitled, "Crossed Pulse Liquid Atomizer," Ser. No. 06/425,122, filed 27 Sept. 1982 and now Pat. No. 4,508,273, and differs therefrom principally in claiming only the burner forms of my invention. These burner forms of my invention were one of the invention categories non-elected by applicant in response to a restriction requirement on the original application ser. no. 06/425122.

BACKGROUND OF THE INVENTION

1. Field of the Invention:

This invention is in the field of liquid atomizers and particularly the field of liquid atomizers used for the burning of high viscosity residual fuels as in diesel engines, and gas turbine burners, and other burners.

2. Description of the Prior Art:

To efficiently burn liquid fuels requires that the liquid be broken up into tiny particles and that these atomized particles be suspended within the combustion air mass so that a large area of liquid is created for fuel evaporation into the air mass. Liquid fuels of higher viscosity are more difficult to thusly atomize adequately since the liquid responds only slowly to the forces causing atomization. In prior art liquid atomizers, these atomizing forces are the aerodynamic forces produced when the liquid moves at a high velocity relative to surrounding air or other gas. These high relative velocities are created by injecting the liquid at high velocity into an essentially stationary air mass, as in many diesel engines, or by moving a gas mass at high velocity across a liquid stream, or by injecting the liquid at high velocity and concurrently moving a gas mass at high velocity across this injected liquid stream, as in air or steam atomizing nozzles used in boilers. These prior art atomizers suffer the defect that the atomizing force, which acts upon the liquid to break it up into small particles, acts also upon the atomizing gas to reduce the relative velocity between liquid and gas, and thus to reduce the atomizing force as atomization proceeds. To efficiently atomize higher viscosity fuels thus requires use of higher liquid injection velocities, and hence pressures, or use of larger masses of atomizing gas where prior art atomizers are used. References A, B, and C describe the atomization process and the effects of liquid viscosity.

Prior art diesel engines are capable of burning high viscosity, residual type fuels, such as Bunker C fuels, but only in engines of large piston diameter and hence of low engine speed and high engine weight. This deficiency of prior art diesel engines results from the use of a high-pressure injector to atomize the liquid fuel in order to spread the liquid out over the large area of contact with air needed for rapid burning. Increasing fuel viscosity retards atomization but this effect can be offset by using higher fuel injection pressures. Fuel viscosity and injection pressure can be increased in this way but only up to the point where the liquid fuel is sprayed on to the combustion chamber surface since such fuel impingement destroys the needed atomization. In this way for each engine piston diameter, or injection path length, there exists a maximum useable injection pressure and a corresponding maximum useable fuel viscosity. Hence we find small piston diameter truck and bus diesel engines requiring low viscosity fuels whereas large piston diameter marine diesel engines can use residual type fuels efficiently. Necessarily then, high viscosity fuels are useable only in prior art diesel engines which are too heavy for use in trucks, buses or railroads since large piston diameter requires a low engine RPM to keep inertia forces reasonable and hence requires a high engine weight per horsepower.

This deficiency of prior art diesel engines has not been important in the past when low viscosity, distillate diesel fuels were readily available at low prices. But this is no longer the case, and it is now important to seek to utilize all kinds of liquid fuels for those transportation applications, such as trucks and buses, whose refueling and fuel handling requirements necessitate use of easily handled liquid fuels. These are also the transportation applications which require light-weight engines and hence require diesel engines of small piston diameter. It would be a great benefit to have available small piston diameter, light-weight engines capable of efficiently burning high viscosity, residual type fuels.

Prior art burners, such as for gas turbine engines or steam boilers, are capable of burning high viscosity fuels but only by use of large diameter burners or by use of large masses of atomizing gas, such as compressed air or high pressure steam. In some gas turbine applications, such as for aircraft, such large diameter burners are a disadvantage. In all cases, the atomizing gas requirement is a disadvantage as costly to supply and reducing efficiency. It would be a great benefit to have an atomizer for these high viscosity residual fuels which could be used efficiently in small diameter burners and which required only small quantities of atomizing gas.

Certain mechanical portions of internal combustion engines are already well known in the prior art such as the pistons, cylinders, crankshafts, etc. The term "internal combustion engine" is used hereinafter and in the claims to mean these already well-known combinations of cylinders, cylinder heads, pistons operative within said cylinders and connected to a crankshaft via connecting rods, valves and valve actuating means or cylinder ports, cams and camshafts, lubrication system, cooling system, ignition system if needed, flywheels, starting system, fuel supply system, fuel air mixing system, intake pipes and exhaust pipes, superchargers, torque control system, etc. as necessary or desired for the operation of said internal combustion engine. The term "internal combustion engine" is used hereinafter and in the claims to include also the already well-known combinations as described above, but wherein the cylinders, cylinder heads, pistons operative within said cylinders and connected to a crankshaft via connecting rods, valves and valve actuating means or cylinder ports, are replaced by a rotary engine mechanism combination, comprising a housing with a cavity therein, and plates to enclose the cavity, a rotor operative within said cavity and sealing off separate compartments within said cavity and connecting directly or by gears to an output shaft, ports in said housing for intake and exhaust, such as in the "Wankel" type engine. An internal combustion engine may be of the four-stroke type, wherein for each cylinder two full engine revolutions or processes are required to complete a single engine cycle of intake, compression, combustion, expansion and exhaust, or alternatively may be of the two-stroke type wherein a single engine cycle is completed, for each cylinder, within a single engine revolution or process, as is well known in the art of internal combustion engines.

The term, "internal combustion engine mechanism," is used herein and in the claims to mean all those portions of an internal combustion engine, as described hereinabove, except the fuel supply system, the fuel air mixing system, the torque control system, and any spark ignition apparatus. The terms, "piston" and "cylinder," are used herein and in the claims to mean these elements as commonly used in piston and cylinder engines, and also includes the functionally corresponding elements as used in other engine types such as the Wankel engine, and further includes cases where more than one piston is used in a single cylinder. The term engine cylinder is used herein and in the claims to include also the cylinder head if used.

The term "burner" is used herein and in the claims to mean those already well known combinations of combustion chamber, combustion air supply means, ignition means, fuel supply system, fuel flow control means, fuel atomizer means, fuel-air mixing system, etc. as necessary or desired for the operation of said burner. The term "combustion chamber" is used herein and in the claims to mean all those portions of a burner, as described hereinabove, except the fuel atomizer means and fuel flow control means.

References

A. National Advisory Committee For Aeronautics, Report No. 454, "Photomicrographic Studies of Fuel Sprays," Lee and Spencer.

B. "The Atomization of Liquid Fuels," Giffen and Muraszew, John Wiley, 1953.

C. "Liquid Fuel Atomization," Frazer, Sixth Symposium (International) On Combustion," Reinhold, New York, 1957, page 687.

SUMMARY OF THE INVENTION

The liquid atomizers of this invention comprise a liquid pulser means, a gas pulser means, a drive and timing means, and these positioned and timed so that each liquid pulse is impacted by a gas pulse moving across its path at least once and it is the pressure wave and the gas flow of the gas pulse which create the atomizing forces. Preferably a gas pulse reflector means is also used and positioned to reflect the gas pulses back toward the liquid pulses so that each gas pulse impacts liquid pulses several times and so that each liquid pulse is impacted by gas pulses several times. In this way strong atomizing forces can be created and repeatedly applied to the liquid without using high liquid velocities and hence without the necessity of large liquid penetration along the path of atomization. This short path of atomization makes possible the use of high viscosity fuels in small piston diameter diesel engines, the necessary fine atomization of the liquid fuel being secured by the repeated gas pulse impacts upon the liquid pulses essentially at right angles to the penetration direction and this is one of the beneficial objects of this invention. Each gas pulse can be efficiently utilized to atomize the liquid since it repeatedly impacts the liquid, and at each impact the reflected gas pulse is moving contrary to the liquid motion induced by atomization. Hence, only small quantities of atomizing gas need be used to secure fine atomization in burners using high viscosity fuels and this is another beneficial object of this invention.

BRIEF DESCRIPTION OF THE DRAWINGS

One form of the invention is shown in FIG. 1, comprising a liquid pulser means, a gas pulser means, and a gas pulse reflector means.

A common rail form of liquid pulser is shown in FIGS. 2 and 3 and a graph of one of its operating modes is shown in FIG. 4.

Figure 6:
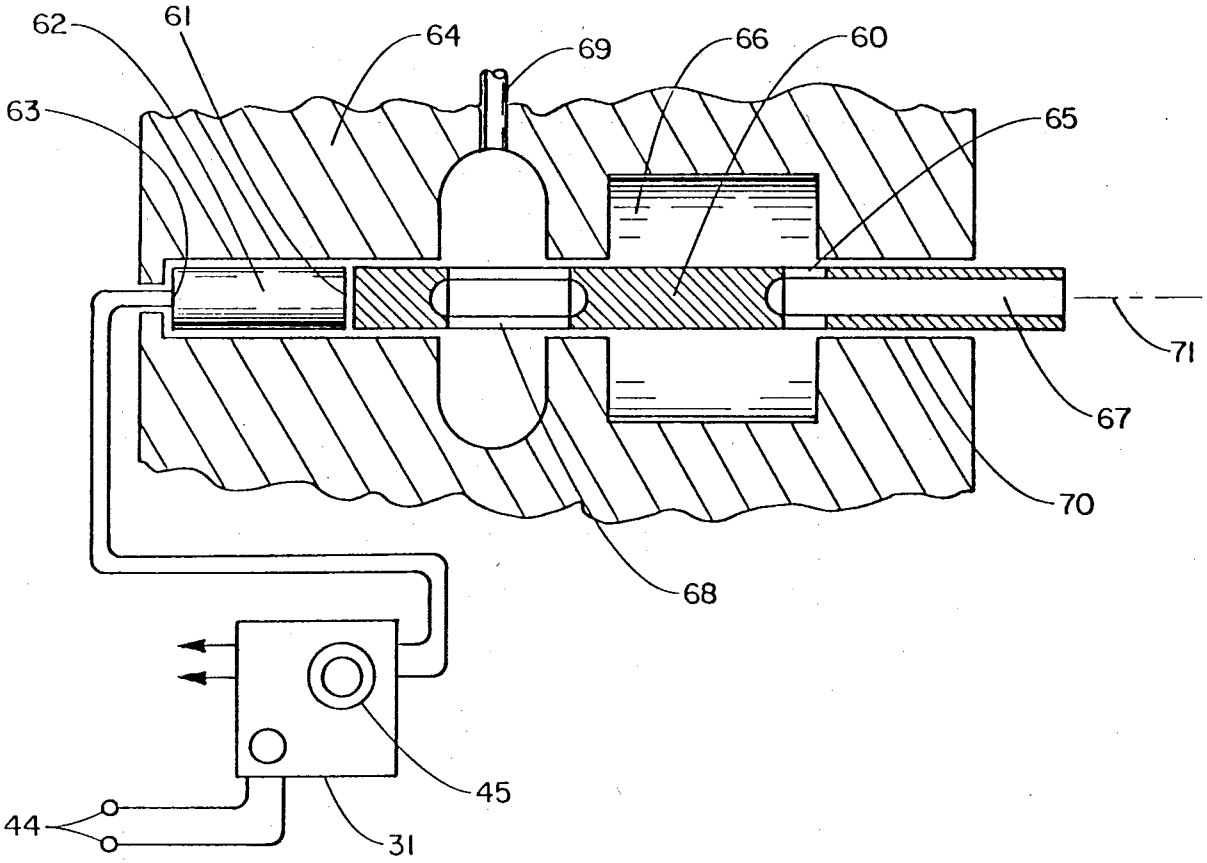
Figure 7:
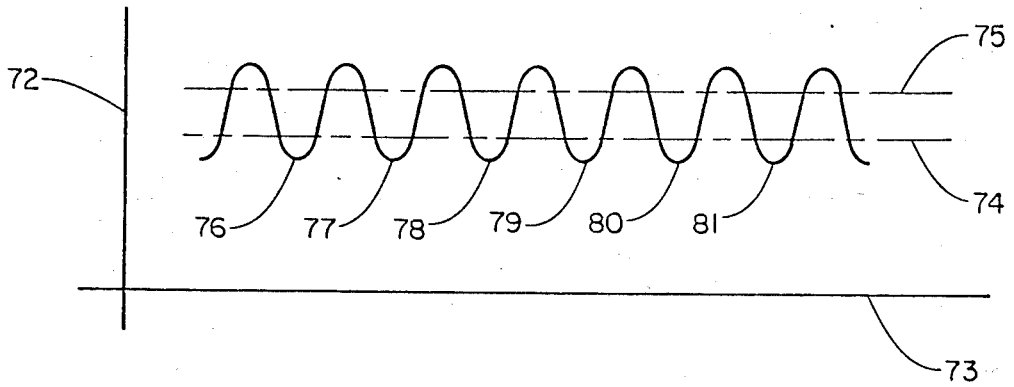

A common rail form of gas pulser is shown in FIG. 6 and a graph of one of its operating modes is shown in FIG. 7.

Figure 1:
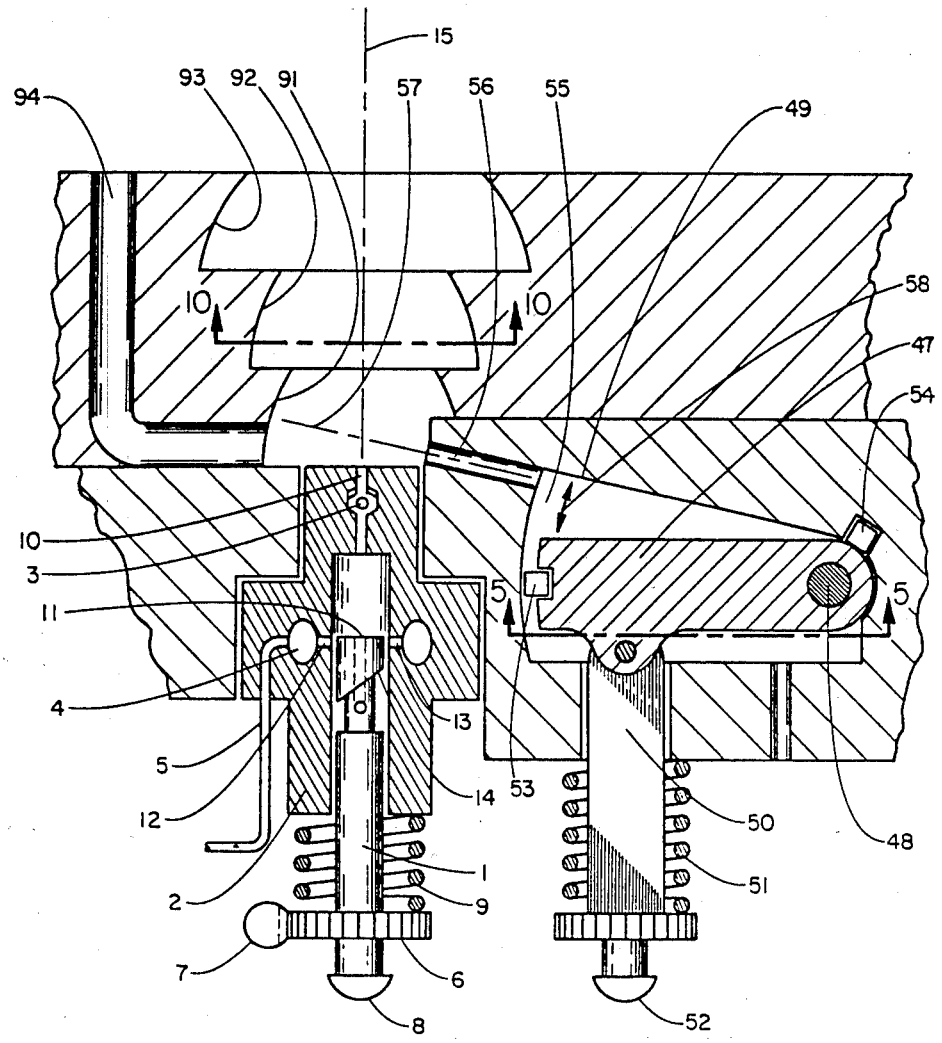
Figure 8:
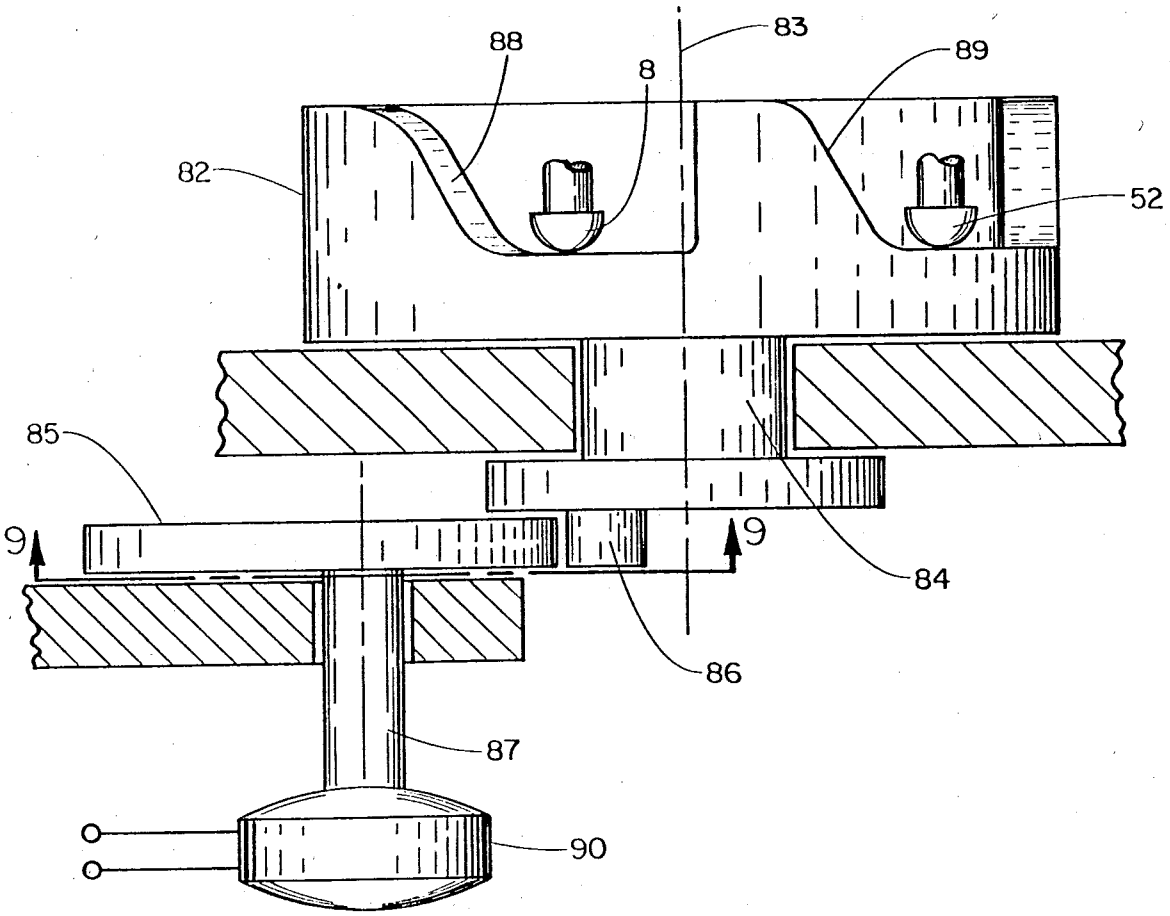
Figure 9:
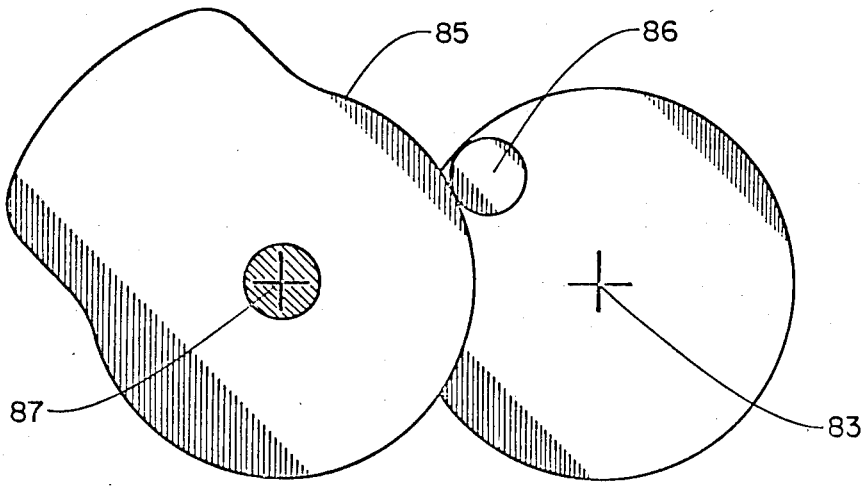

A mechanical means for driving and timing the liquid pulser and the gas pulser of the FIG. 1 form of this invention is shown in FIGS. 8 and 9.

Figure 10:
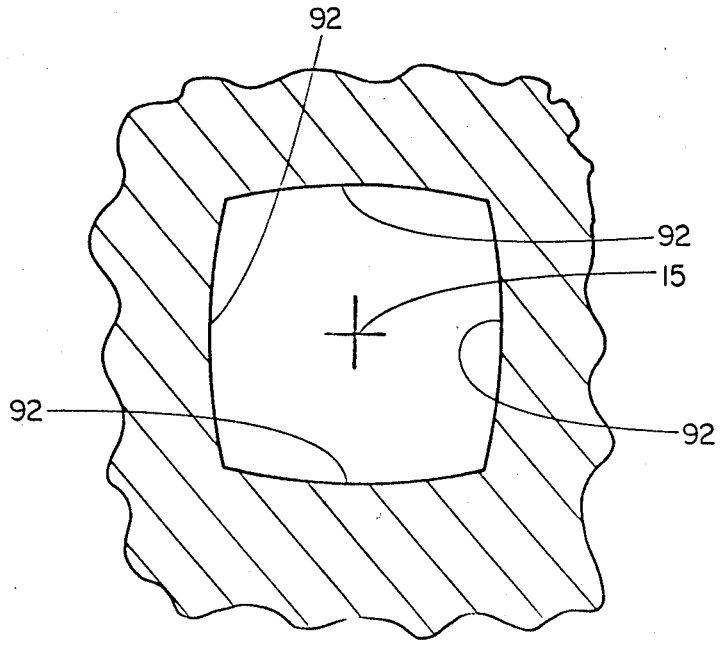

A cross-sectional view of one form of the gas pulse reflector means of FIG. 1 is shown in FIG. 10.

Figure 11:
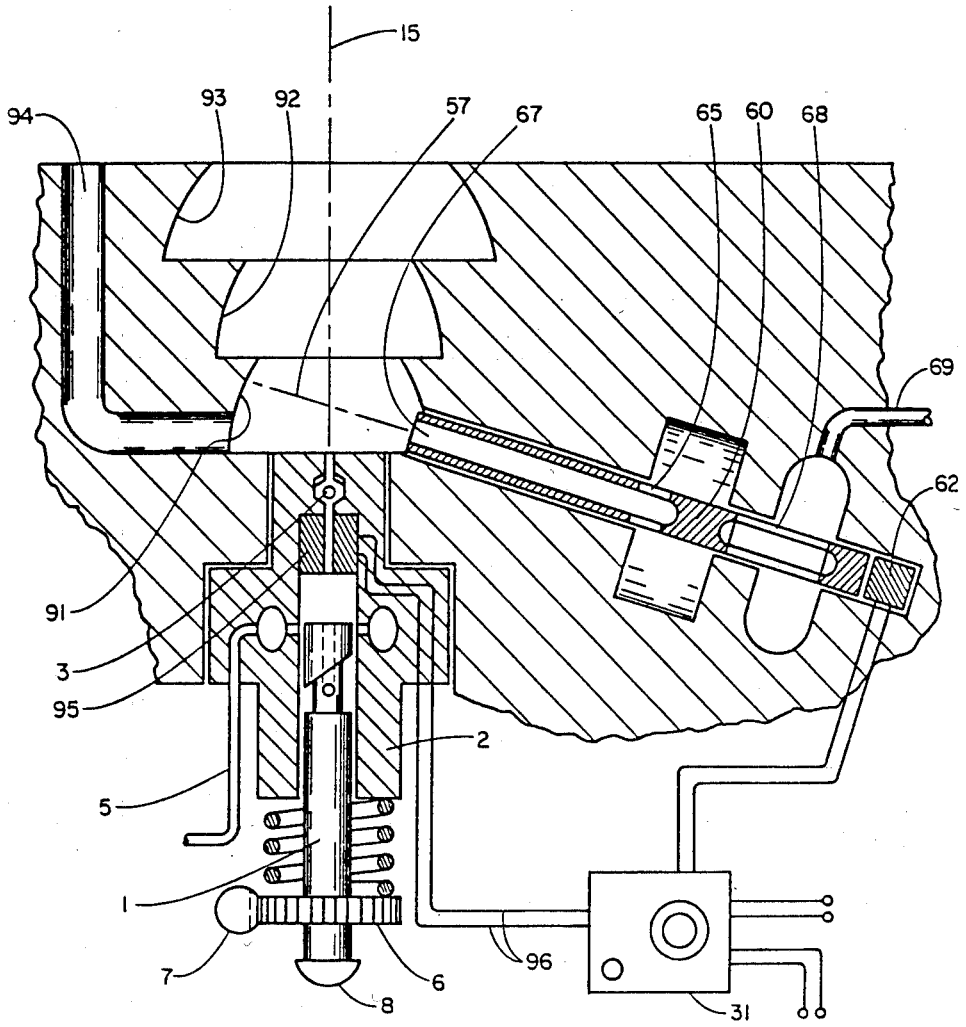
Figure 12:
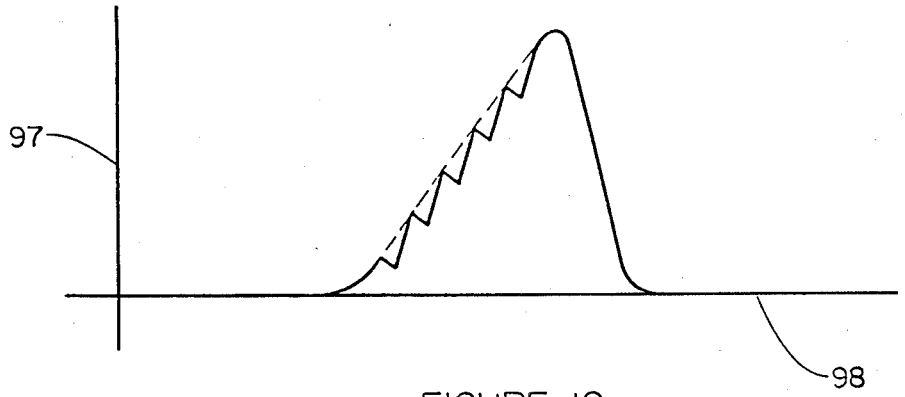

Another form of this invention is shown in FIG. 11, comprising a liquid pulser means, a gas pulser means, and a gas pulse reflector means, and a graph of one of the operating modes of the liquid pulser is shown in FIG. 12.

Figure 13:
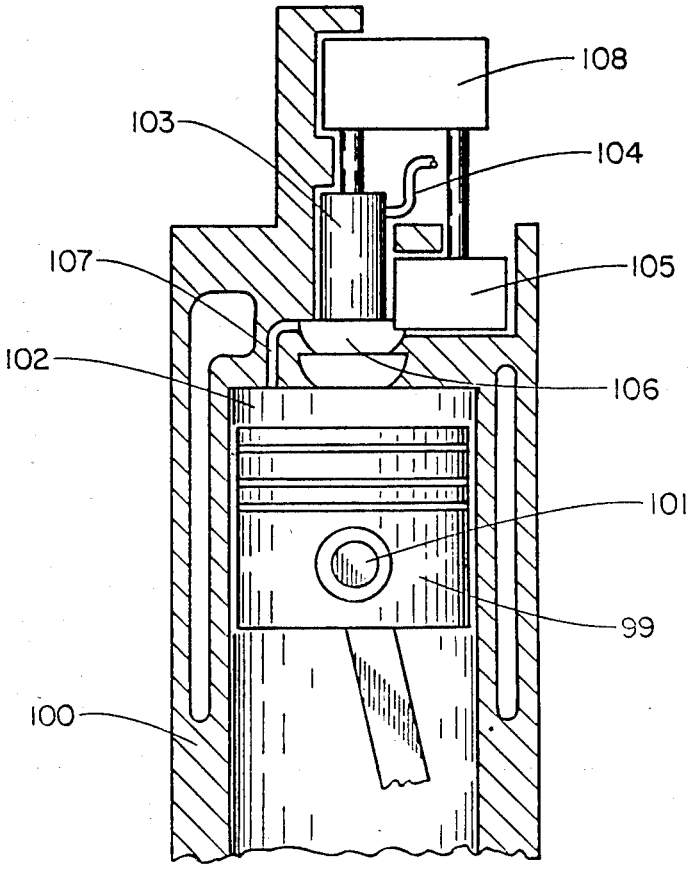

A combination of a crossed pulse liquid atomizer with an internal combustion engine is shown in FIG. 13.

Figure 14:
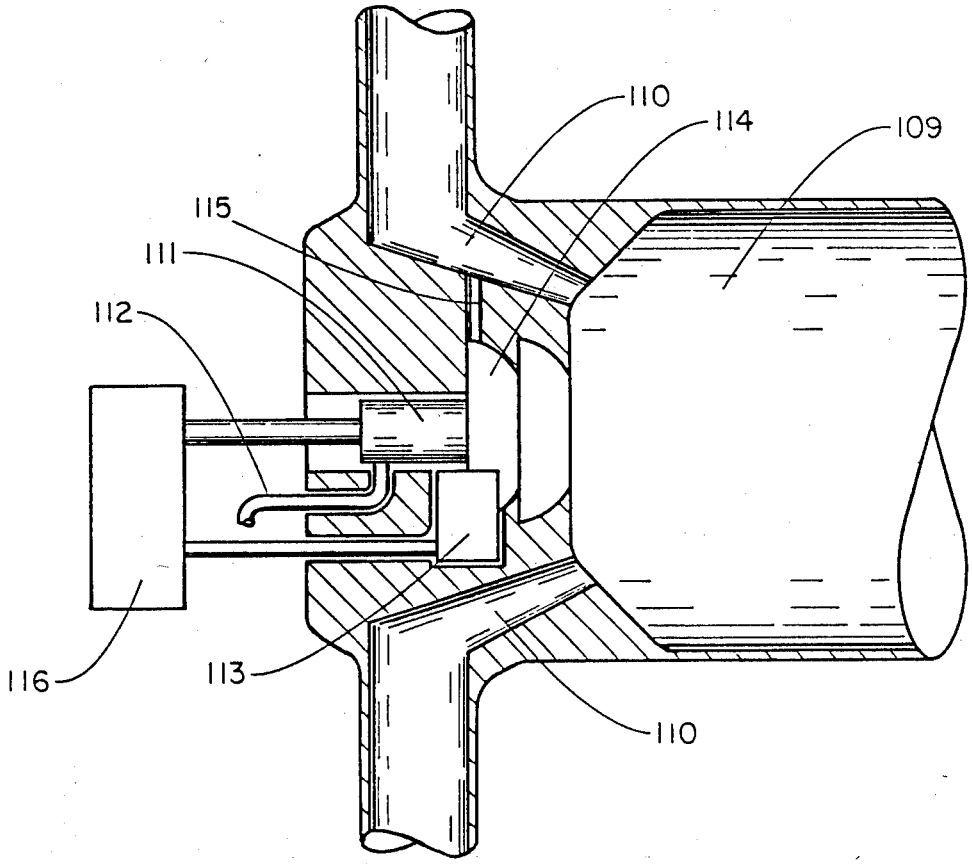

A combination of a crossed pulse liquid atomizer with a liquid fuel burner is shown in FIG. 14.

DESCRIPTION OF THE PREFERRED EMBODIMENTS

Various kinds of liquid pulser means, gas pulser means, drive and timing means, and gas pulse reflector means can be used and in various combinations for crossed pulse liquid atomizers. Examples of some kinds of these elements and some of these combinations are described hereinafter together with examples of their use in combination with diesel engines and with liquid fuel burners.

The liquid pulser is a means for creating liquid pulses and directing each pulse to travel along a trajectory. Various kinds of liquid pulsers are suitable for the purpose of this invention including positive displacement pulsers and common rail pulsers. The liquid pulser can be driven in various ways such as mechanically or electrically as by use of piezoelectric drive. The path followed by a liquid pulse after it leaves the pulser is herein and in the claims termed the trajectory of that liquid pulse. The centerline of the liquid pulse trajectory is the path followed by the center of mass of the liquid pulse while traveling on the trajectory. Different pulses may travel along the same or different trajectories. The liquid pulser also functions to control the quantity of liquid in each liquid pulse and the number of liquid pulses created.

One example of a positive displacement liquid pulser suitable for mechanical drive is shown in FIG. 1 and comprises a pump piston, 1, operating in a pump cylinder, 2, with a delivery check valve, 3, a liquid gallery, 4, supplied with liquid via the pipe, 5, a pump piston rotator gear, 6, engaged to a control rack, 7, and these are essentially similar to the well-known Bosch fuel injection pump as widely used on diesel engines. The pump piston, 1, can be cam driven via the piston end, 8, with return motion caused by the spring, 9. The check valve, 3, spring force is adequate to prevent fuel flow via the nozzle, 10, when only fuel supply pressure is applied thereto. Liquid pulse creation thus commences when the rising pump piston top edge, 11, covers the ports, 12, 13, and ceases when the tapered edge, 14, uncovers the relief port, 13. The liquid volume in the pulse is proportional to the distance between the top edge, 11, and the tapered edge, 14, in the line through the relief port, 13, and this can be adjusted by rotation of the pump piston, 1, via the rotator gear, 6, and control rack, 7, as is well known in the prior art of Bosch type diesel fuel injection pumps. For the example liquid pulser shown in FIG. 1 one liquid pulse is created for each upward stroke of the pump piston, 1, and with the single straight hole nozzle, 10, shown, each of these pulses will travel the same upward trajectory, starting at the exit of the nozzle, 10, and moving along the trajectory centerline, 15.

Figure 2:
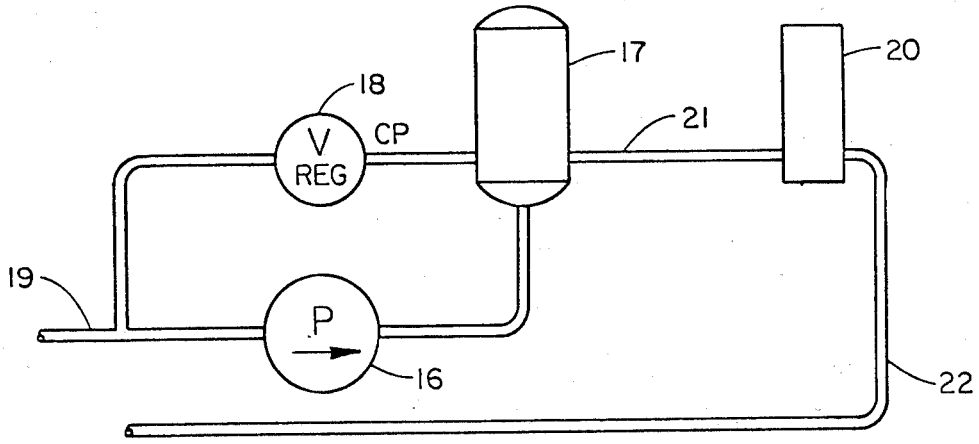
Figure 3:
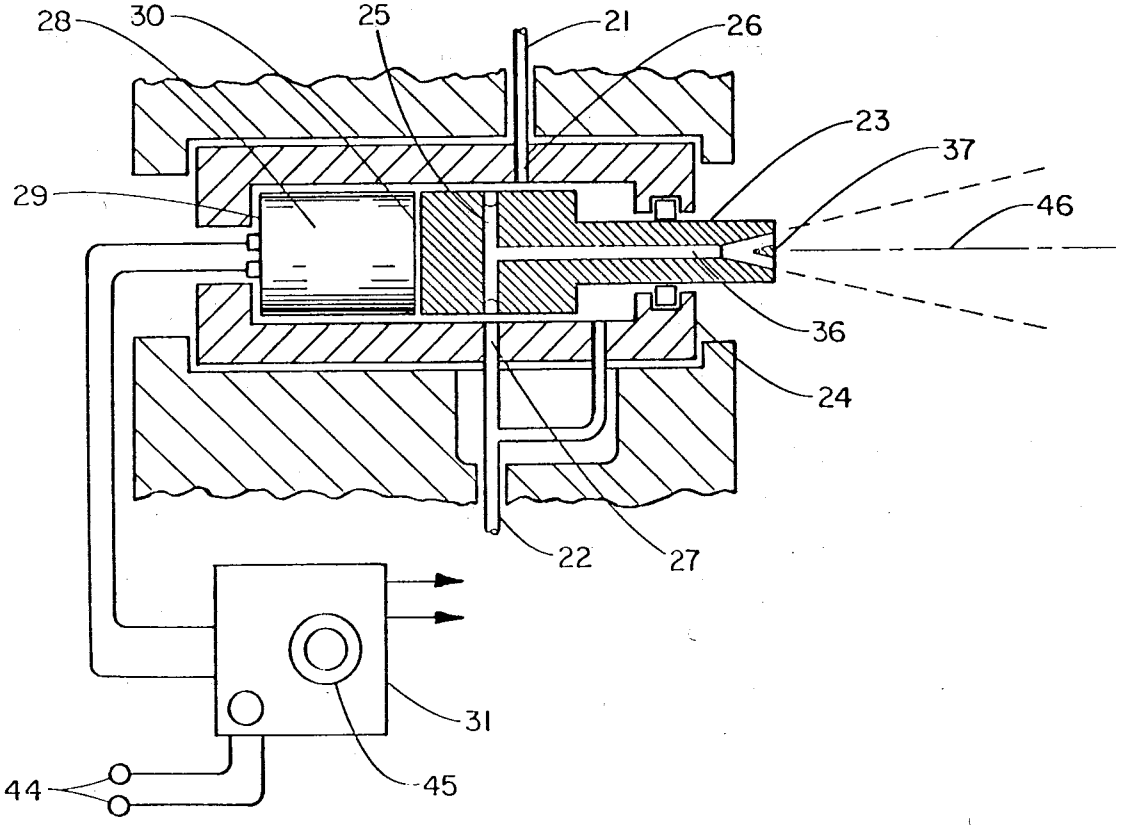
Figure 4:
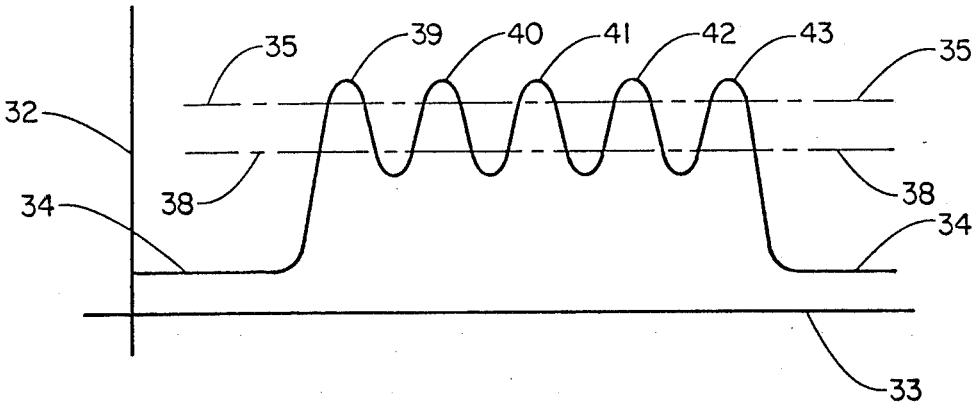

An example of a common rail liquid pulser means with an electric drive is shown schematically in FIGS. 2 and 3 and comprises a positive displacement liquid transfer pump, 16, pumping into a high-pressure gas pressurized accumulator, 17, whose liquid pressure is held constant by the constant pressure back pressure valve, 18, which returns excess liquid from the accumulator, 17, to the liquid supply pipe, 19. The liquid pulser valve, 20, is supplied with high pressure liquid from the accumulator, 17, via the pipe, 21, and return flow of valve leakage and vented liquids occurs via the pipe, 22. The liquid pulser valve, 20, is shown in greater detail in FIG. 3 and comprises a valve element, 23, moving sealably inside a housing, 24, so as to index a valve port, 25, either with a high pressure liquid supply port, 26, connected to the high-pressure liquid pipe, 21, from the accumulator, 17, or with a liquid vent port, 27, connected to the vent pipe, 22, or to neither the supply or vent port. The moving valve element, 23, can be moved by various kinds of drive means and a piezoelectric drive means is shown schematically in FIG. 3 and comprises a piezoelectric element, 28, with one end, 29, fixed to the housing, 24, and the other end, 30, fixed to the moving valve element, 23, these ends, 29, 30, being the deflecting ends of the piezoelectric element, 28. The piezoelectric element, 28, can be deflected via the electic drive means, 31, at various frequencies and amplitudes, one example of which is shown in FIG. 4, which is a graph of deflection amplitude of the piezoelectric element, 28, and hence of motion of the moving valve element, 23, on the vertical axis, 32, against time along the horizontal axis, 33. At amplitude, 34, the moving element valve port, 25, is sealed and not indexed to any port. At amplitude, 35, the moving element valve port, 25, indexes the high pressure liquid supply port, 26, and while thusly indexed a pulse of liquid passes through the port, 26, the port, 25, the passage, 36, and exits via the spray nozzle, 37. At amplitude, 38, the moving element valve port, 25, indexes the vent port, 27, and liquid can be vented from port, 25, and passage, 36, to prevent nozzle dribbling. For the amplitude versus time diagram, shown as an example in FIG. 4, a pattern of five separated liquid pulses, 39, 40, 41, 42, 43, is created and this pattern of pulses can be subsequently repeated at some desired rate of pulse patterns per unit of time. Other amplitude versus time diagrams can also be used such as continued creation of separate liquid pulses without interruption. The amplitude versus time diagram is set by the electric drive means, 31, powered from the power inlets, 44, and the pulse pattern, pulse frequency, and pulse duration can be made adjustable, as by knobs, 45, by methods already well known in the art of piezoelectric drivers. The quantity of liquid in each liquid pulse can be controlled by controlling either pulse duration, or liquid pressure in the accumulator, 17, or both. A hollow cone spray nozzle, 37, is shown in FIG. 3 as an example scheme for causing each liquid pulse to spread out after it leaves the nozzle and this spreading aids atomization by thinning the liquid mass. If the hollow cone of the spreading liquid pulse is symmetrical about the nozzle passage, 36, the liquid pulse trajectory centerline will align at, 46, with this passage, 36. Other methods for causing the liquid pulse to spread can also be used such as rotational guide passages, pintles, diverging slots, multiple nozzle exit holes, etc., as is already well known in the art of liquid atomizers.

The gas pulser is a means for creating gas pulses and directing each pulse to travel along a trajectory. Various kinds of gas pulsers are suitable for the purposes of this invention including positive displacement pulsers and common rail pulsers. The gas pulser can be driven in various ways such as mechanically or electrically as by use of piezoelectric drive. The path followed by a gas pulse after it leaves the pulser is herein and in the claims termed the trajectory of the gas pulse. The centerline of the gas pulse trajectory is the path followed by the center of mass of the gas pulse while traveling on the trajectory. Different pulses may travel along the same or different trajectories. The gas pulser also functions to control the number of gas pulses created.

It is the pressure wave and the gas flow of the gas pulse which are to create the atomizing forces upon the liquid pulse. To minimize liquid pulse penetration along its trajectory, it is preferable that the gas pulse trajectory be at about ninety degrees across the liquid trajectory. In this way the atomizing forces do not speed up the liquid motion along its trajectory and hence do not act to increase the penetration. Hence, the gas pulse trajectory centerline is to intersect, but not coincide with, the liquid pulse trajectory centerline. Since it is the liquid which is to be atomized, each liquid pulse trajectory centerline is to be thusly intersected by at least one gas pulse trajectory centerline. Hence, the gas pulser is positioned relative to the liquid pulser so that this intersection of centerlines is obtained. Additionally, the gas pulse and the liquid pulse are to arrive at the centerline intersection at essentially the same time so that the gas pulse can act upon the liquid pulse to atomize it and this interaction of a gas pulse with a liquid pulse is herein and in the claims termed an impact. The driver means for driving and timing the gas pulser and the liquid pulser times the gas pulse, relative to the liquid pulse, so that an impact is obtained at the intersection of the trajectory centerlines and this driver means is described hereinafter. So that all of the liquid pulse will be acted upon by the atomizing forces, we prefer that the early portions of the gas pulse arrive first at the trajectory centerline intersection and that the gas pulse be of sufficient duration that the last portions of the gas pulse arrive at the intersection after the last portions of the liquid pulse. For any particular size and type of liquid pulse, finer atomization can be obtained by increasing the atomizing force generated by the gas pulse. Such increase of atomizing force can be achieved in various ways, as by increasing the gas pulse pressure wave and gas flow speed, or by increasing the mass of gas in each gas pulse. Alternatively, for any particular gas pulse size and strength, finer atomization can be obtained by reducing the quantity of liquid within each separate liquid pulse acted upon by the gas pulse. The atomizing forces created by the gas pulse act upon the outer surface of the liquid pulse and the finer atomization results from the higher surface to volume ratio of smaller liquid pulses.

Figure 5:
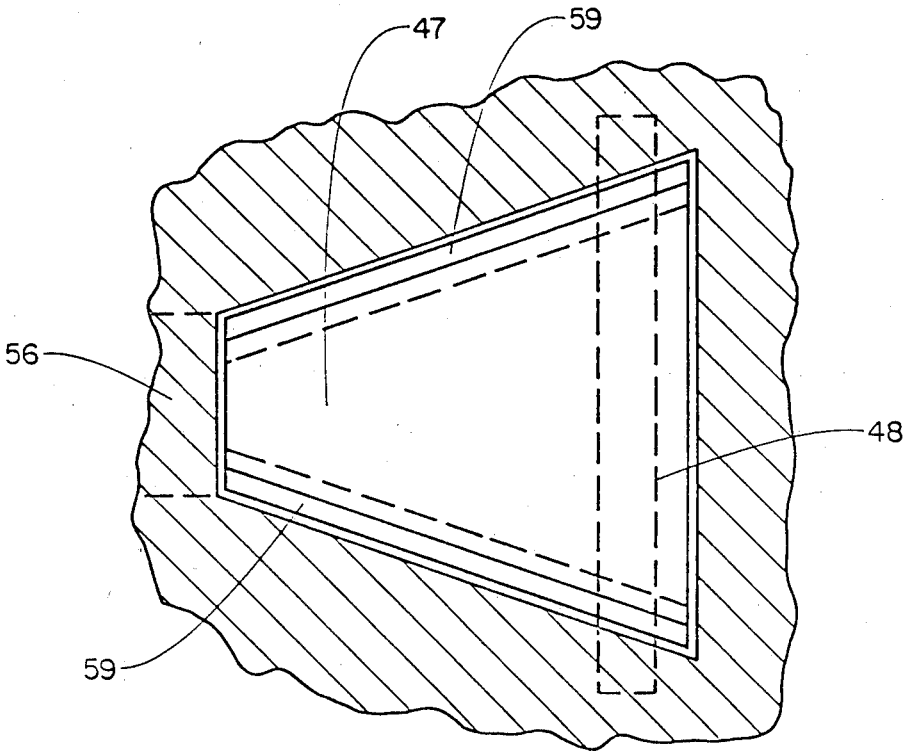
In FIG. 5 is shown a cross-sectional view of one form of the gas pulser piston, 47, of FIG. 1.

One example of a positive displacement gas pulser suitable for mechanical drive is shown in FIG. 1 and comprises a hinged piston, 47, hinged on the shaft, 48, and driveable to close immediately adjacent to the surface, 49, by the drive bar, 50, and openable by the spring, 51. The drive bar, 50, can be thusly driven by cams or other means via the bar end, 52. The piston, 47, is sealed via sealing elements, 53, 54, against those surfaces of the pulser cavity, 55, across which the piston moves. Hence, when the piston, 47, is driven from its open position to its closed position adjacent the surface, 49, the gas in the pulser cavity, 55, is forced out the gas pulser nozzle, 56, as a single gas pulse. The thusly generated gas pulse travels along a trajectory whose centerline, 57, is established by the nozzle passage, 56, so as to intersect the liquid pulse trajectory centerline, 15. Note that as shown in FIG. 1, the gas pulse moves across the liquid pulse so that the atomizing forces act in this direction rather than in a direction to increase penetration. Increasing the speed of closure of the piston, 47, through the pulser cavity gap, 58, produces gas pulses of increasing pressure wave strength and of increasing gas flow speed but of shorter duration. Increasing the working area of the piston, 47, also increases the pressure wave strength and gas flow speed of the gas pulse at any particular duration. Hence, any desired duration and strength of gas pulse can be obtained by suitable design of the piston, 47, area and closing speed, and the cavity gap, 58, length. Where a spreading liquid pulse is used, as shown for example in the liquid pulser of FIG. 3, the gas pulse also preferably spreads so that all portions of the liquid pulse are impacted by portions of the gas pulse. Such a spreading gas pulse can be created in various ways, as, for example, by using a tapered piston, 47, as shown in FIG. 5. The tapered piston produces components of gas flow velocity parallel to the surface of the piston, 47, and across the principal gas pulse flow direction and these transverse gas flows will cause the gas pulse to spread as it leaves the nozzle, 56.

An example of a common rail gas pulser means with an electric drive is shown in FIG. 6 and comprises a pulser valve, 60, secured to one end, 61, of a piezoelectric driver, 62, whose other end, 63, is secured to the valve housing, 64, these ends, 61, 63, being the deflecting ends of the piezoelectric element, 62. The piezoelectric element, 62, can be deflected via the electric drive means, 31, at various frequencies and amplitudes, and this could be the same drive means as used for the common rail liquid pulser of FIG. 3 with a separate drive circuit for the gas pulser. When the pulse port, 65, is open to the gas cavity, 66, a pulse of gas flows from the cavity through the port, 65, and out the nozzle, 67. When the refill port, 68, is open to the gas cavity, 66, the cavity is refilled with highpressure gas via the gas supply pipe, 69, the pulse port, 65, being then closed inside the cylinder, 70, and thereafter the gas pulser of FIG. 6 is again ready to create another gas pulse. The gas pulse thus created travels along a trajectory whose centerline, 71, is set by the nozzle, 67. The high-pressure gas supply can be from various sources, such as the pump and accumulator scheme of FIG. 2, but with gas pumps, valves, and accumulators. One example of a valve, 60, amplitude, 72, versus time, 73, graph is shown in FIG. 7. At amplitude, 74, the pulse port, 65, opens into the cavity, 66, and at amplitude, 75, the refill port, 68, opens into the cavity, 66, and in this way gas pulses, 76, 77, 78, 79, 80, 81, are created at a frequency equal to the frequency at which the piezoelectric element, 62, is energized by the driver, 31, and hence the frequency of the pulser valve, 60. The basic operation of the common rail gas pulser of FIG. 6 is seen to be the same as that of the common rail liquid pulser of FIGS. 2 and 3 except that gas pulses are released instead of liquid pulses. The quantity of gas in each gas pulse can be controlled by controlling either the pressure of gas supply or the volume of the cavity, 66, or both.

Piezoelectric drive is shown in the example common rail gas and liquid pulsers shown in FIGS. 2, 3, 4, 6, and 7 but mechanical or other drive means could alternatively be used with these common rail systems.

Where the common rail liquid pulser of FIGS. 2 and 3 is used with the common rail gas pulser of FIG. 6, a common electric drive means, 31, can be used and the same drive frequency can be applied to the liquid pulser as to the gas pulser so that each liquid pulse can be impacted by one gas pulse. The drive means, 31, can also set the relative timing of each gas pulse relative to the liquid it is to impact so that an impact of the two pulses is obtained.

A drive and timing means is needed to drive the liquid pulser and the gas pulser and to time these pulses relative to each other so that each liquid pulse is impacted by at least one gas pulse while the gas pulse is traveling along its trajectory. Various kinds of drive and timing means can be used for the purposes of this invention such as mechanical drive and timing means, electrical drive and timing means, hydraulic drive and timing means, etc. For example, the electrical drive means, 31, of FIGS. 3 and 6 can be an electric oscillator whose generated frequency equals the desired gas and liquid pulse frequency. When both pulsers are driven by a common drive means, two outputs can be created by the oscillator of the same frequency but with the phase relation shifted so as to secure the desired impact of liquid pulse and gas pulse. The amplitude of the oscillator output as well as the frequency can be made adjustable if desired. Such oscillators are well known in the art of piezoelectric drives.

One example of a mechanical drive and timing means suitable for use with the positive displacement liquid pulser and the positive displacement gas pulser of FIGS. 1 is shown in FIGS. 8 and 9. The barrel cam, 82, is oscillated about the centerline, 83, on its shaft, 84, by the cam, 85, acting on the crank, 86, the cam, 85, being rotated by the shaft, 87. The barrel cam surface, 88, acts to drive the liquid pulser piston end, 8, and the barrel cam surface, 89, acts to drive the gas pulser bar end, 52, and for this design of barrel cam one gas pulse is thus created for each liquid pulse created. The timing of the gas pulse relative to the liquid pulse can be set by setting the distances between the barrel cam surfaces, 88, 89, and the pulser driven members, 8, 52. The rate of generation of liquid pulses and gas pulses can be set by setting the speed of rotation of the shaft, 87, driving the cam, 85. A single barrel cam, 82, can drive one liquid pulser and one gas pulser as shown in FIGS. 8 and 9, or alternatively can drive several liquid pulsers and/or several gas pulsers by providing the necessary cam surfaces such as, 88, 89. In some applications it may be preferred that the liquid pulser and gas pulser be driven by separate cams instead of the same cam as shown in FIGS. 8 and 9. The cam shaft, 87, can be driven by an electric motor, 90, or from the crankshaft or camshaft of an engine or by other means.

The mechanical work needed to drive the liquid pulser and the gas pulser is lost work and is preferably minimized. Of the two, the gas pulser work will usually be much the larger and this gas pulser lost work increases as larger or stronger gas pulses are used to secure finer atomization of the liquid pulses. We thus seek to utilize the gas pulse as efficiently as possible so that fine atomization can be obtained without excessive lost work. The efficiency of utilization of the gas pulses can be improved by use of a gas pulse reflector cavity as a means to reflect gas pulses from solid reflector surfaces back to impact liquid pulses again and several of these reflected impacts can be used. Each reflected impact reapplies atomizing forces to the liquid pulse and thus improves atomization without, however, requiring any additional work input to the gas pulser whose efficiency is thusly improved. Additionally, penetration is reduced since the multiple reflected impacts break up the liquid more quickly and the resulting increased drag forces slow down the liquid more quickly. Hence, a gas pulse reflector cavity means is used on the preferred forms of this invention.

The gas pulse reflector means comprises a cavity surrounded by solid gas pulse reflector surfaces and positioned about the liquid pulse trajectories so that liquid pulses do not strike the gas pulse reflector surfaces. Liquid pulses striking solid surfaces collect thereon and are thus deatomized and this result we seek to avoid by proper location of the gas pulse reflector surfaces so they are not struck by liquid pulses.

One example arrangement of a gas pulse reflector means is shown in FIGS. 1 and 10 and comprises three solid reflector surfaces, 91, 92, 93, arranged in three stepped segments with these reflector surfaces surrounding the liquid pulse trajectory centerline, 15, at a sufficient distance that liquid will not strike the reflector surfaces.

Where gas pulse reflectors are to be used to secure a series of reflected impacts following the initial impact, it is preferred that the original gas pulse have a velocity component in the direction of liquid pulse motion approximately equal to the liquid pulse velocity. Hence, it is necessary that gas pulse velocity be appreciably greater than liquid pulse velocity so that the gas pulse crosses the liquid pulse trajectory at somewhat less than a ninety degree angle of intersection in order to minimize penetration, and so that the reflected gas pulse, traveling a longer path, can keep up with the liquid pulse to yield repeated impacts. Preferably, then, the gas pulse trajectory centerline intersects the liquid pulse trajectory centerline at an angle less than ninety degrees as is shown, for example, in FIG. 1. Alternatively, though not preferably, the initial impact can be made at ninety degrees and the gas pulse given a motion component along the liquid pulse motion direction by the first gas pulse reflector surface. Following the first gas pulse to liquid pulse impact, a reflector surface is to reflect the gas pulse back to impact the liquid pulse again and further along on the liquid pulse trajectory by the length of liquid pulse motion between impacts. A flat reflector surface parallel to the liquid pulse trajectory centerline would accomplish this function if liquid pulse speed and gas pulse speed were unchanged by impact and if gas pulse velocity component along the liquid pulse trajectory equalled liquid pulse velocity as preferred. But at each impact the atomizing force acts equally on the liquid pulse and the gas pulse with the following results:

a. gas pulse velocity is reduced and the direction of motion is changed toward the liquid pulse trajectory, and these two effects tend to offset one another on their effect upon gas pulse velocity component along the original liquid pulse trajectory;
b. liquid pulse velocity direction is changed toward the gas pulse trajectory and the atomization caused by impact acts to slow up the liquid pulse, and both of these effects act to reduce the liquid pulse velocity component along the original liquid pulse trajectory;
c. hence, in most cases, the liquid pulse would lag behind the gas pulse along the original liquid pulse trajectory if the flat and parallel gas pulse reflectors were used and the gas pulse would tend to miss the liquid pulse on subsequent impacts, particularly when short duration gas pulses are used.

For this reason, the gas pulse reflector surfaces preferably slope toward the liquid pulse trajectory centerline in the direction of liquid pulse motion so that the gas pulse component along the liquid pulse trajectory is sufficiently slowed down that the gas pulse will impact the liquid pulse after each reflection. This requires that, for any particular separate reflector surface, the distance to the reflector surface from the liquid pulse trajectory centerline, along a series of lines normal to this centerline all of which lines are contained within a plane also containing this centerline, shall decrease in the direction of motion of the liquid pulse. This sloping of the reflector surface is shown in FIG. 1 for each of the three separate reflector surfaces, 91, 92, 93. It can be seen in FIG. 1 that where more than one gas pulse reflector is used, each reflector is preferably a stepped back segment so that the reflector slope will not cause those reflectors last reflected on to come too close to the liquid pulse and cause it to strike a reflector surface. This stepping back of the reflector surfaces to avoid liquid striking thereon is additionally needed since atomization of the liquid pulse tends to spread the liquid pulse out as it moves along. A reflector surface longitudinally concave when viewed from the liquid pulse trajectory centerline, in a plane containing the liquid trajectory centerline as is shown in FIG. 1, can act to refocus a gas pulse scattered by a previous impact in that the slower portions of the gas pulse are less slowed down in the liquid pulse direction by the concave reflector than are the faster portions of the gas pulse and hence can catch up for the next impact. A similar refocusing of scattered gas pulse portions can result from use of transverse concave surfaces when viewed from the liquid pulse trajectory centerline in a plane normal to the liquid trajectory centerline as is shown in FIG. 10. Alternatively, this transverse concavity can be reduced or flat surfaces used where it is desired to further spread out the gas pulse after each reflection in order to fully impact a liquid pulse which is spreading out transversely as it proceeds along its trajectory.

As an alternative to the sloped and stepped segment reflectors described hereinabove, a very long duration gas pulse can be used wherein only the first portion of the gas pulse participates in the first impact and later portions of the gas pulse participate in the later reflected impacts when they catch up with the liquid pulse. In this way, several reflected impacts can be obtained even with parallel reflectors but the longer duration gas pulse requires greater gas pulser work loss if equal gas pulse pressure rise and flow velocity are used.

In some atomizer applications, it will be desired to allow flow of gases into the liquid pulse entry end of the cavity of the gas pulse reflector means without having such return flow occur within the cavity itself. This return flow can be provided for by placing return flow passages within the reflector means and behind the reflecting surfaces, such as the return flow passage, 94, shown in FIG. 1.

The design of gas pulse reflector means most efficient for use with any one particular combination of liquid pulser and gas pulser is best determined experimentally by trying out various reflector arrangements and measuring the resulting average particle size of the atomized liquid or, in some cases, the proportion of particles above a certain limiting size. For example, where an atomizer of this invention is to be used in a diesel engine, the criteria of gas pulse reflector efficiency could be engine exhaust smoke density and engine efficiency at each particular engine torque and speed.

In many cases, it may be preferable that supersonic gas pulses are used since the pressure wave is then closely followed by a mass of flowing gas and both the pressure wave and this flowing gas can act to atomize the liquid pulse. With subsonic gas pulses, the pressure wave, being sonic, will tend to run ahead of the slower gas flow and for the later impacts, it may be impossible to have both the pressure wave and the gas flow acting upon the liquid pulse. For common rail gas pulsers, such as that shown in FIG. 6, supersonic gas pulses can be obtained by supplying the high pressure gas, as at pipe 69, at a pressure greater than about twice the discharge pressure of the gas pulser nozzle exit. For hinged positive displacement gas pulsers, such as that shown in FIG. 1, supersonic gas pulses can be obtained by closing the hinged piston, 47, through the pulser cavity gap, 58, at a speed greater than that given by the following approximate relation:

$$V=(C/l)\,S$$

wherein, V, is the minimum, or sonic, closing velocity of the hinged piston, 47, for closing the pulser cavity gap, 58, whose width is C, and the hinge length at right angles to the hinge shaft, 48, is l, and S, is the sonic velocity in the gas being pulsed.

Various combinations of the aforedescribed elements can be used in liquid atomizers of this invention as preferred for each particular application. For example, two or more separate liquid pulsers can be used together, and these can be supplied with different liquids. Similarly, two or more separate gas pulsers can be used in the same atomizer and these can impact the same or different liquid pulses and can be separated angularly about the liquid pulser. Where two or more separate liquid pulsers are used, two or more separate liquid trajectories and trajectory centerlines will exist for a single atomizer. Also positive displacement liquid pulsers can be used with common rail gas pulsers and vice versa. Examples of some of these combinations of elements will be described to illustrate some applications of the crossed pulse liquid atomizers of this invention.

One example of a crossed pulse liquid atomizer of this invention is shown in FIG. 11 wherein a positive displacement liquid pulser similar to that of FIG. 1 is used with a common rail gas pulser similar to that of FIG. 6 and adapted for combined mechanical and electrical drive and timing means. The positive displacement liquid pulser of FIG. 11 Comprises a pump piston, 1, cylinder, 2, check valve, 3, liquid supply pipe, 5, control rotator gear, 6, and rack, 7, etc., and these operate in the same manner when driven via the piston end, 8, by a mechanical drive and timing means such as that of FIGS. 8 and 9, as already described hereinabove. The common rail gas pulser of FIG. 11 comprises a pulser valve, 60, piezoelectric driver, 62, pulse port, 65, nozzle, 67, refill port, 68, gas supply pipe, 69, etc., and these operate in the same manner when driven by an electrical drive and timing means, 31, as already described hereinabove. The cavity gas pulse reflector means of FIG. 11 comprises reflector surfaces, 91, 92, 93, and return flow passage, 94, and these function in the same manner as already described hereinabove. The gas pulse trajectory centerline, 57, intersects but does not coincide with the liquid pulse trajectory centerline 15. An additional piezoelectric liquid pulser, 95, can be used to produce a group of several separate liquid pulses for each single stroke of the pump piston, 1. The piezoelectric liquid pulser, 95, can be driven to deflect in the direction of the liquid pulse trajectory centerline, 15, by the electric drive and timing means, 31, via the connections, 96. When the piezoelectric pulser, 95, is deflected to lengthen the high delivered liquid volume is the sum of this piezoelectric displacement plus the pump piston displacement. When the piezoelectric pulser, 95, is deflected to shorten the low delivered liquid volume is the pump piston displacement minus the piezoelectric displacement and this net displacement is preferably zero or slightly less than zero. In this way, the liquid pulser of FIG. 11 delivers a series of separated liquid pulses for each stroke of the pump piston, 1, and the separation of these pulses is improved when the low delivered liquid volume is negative as is preferred. These displacement characteristics are shown graphically in FIG. 12 where liquid displaced is plotted vertically, 97, against time horizontally, 98, for a particular case where the low delivered volume is negative and where the piezoelectric pulser, 95, is deflected only while the pump plunger, 1, is displacing liquid. In many cases, it will be preferred that the piezoelectric pulser, 95, be deflected only while the pump plunger, 1, is displacing liquid in order to avoid possible dribbling of liquid out the nozzle when the pump plunger, 1, is stationary or not pumping. When the pump plunger, 1, commences displacing liquid, the pressure of the liquid will rise next to the piezoelectric pulser, 95, and this pressure rise can be used to generate an electric signal back to the electric driver, 31, which will start the driver, 31, to deflect the piezoelectric driver, 95. Similarly, when the pump plunger, 1, ceases displacing liquid, a pressure drop occurs and the consequent electric signal can act to stop the driver, 31. The deflecting of the gas pulser piezoelectric element, 62, can also be thusly started and stopped by the pumping motions of the liquid pump plunger, 1, and in this way pulses are created only when liquid pulses are created, thus avoiding gas pulser flow wastage and work loss. The driver and timing means, 31, can adjust the phasing of the gas pulses relative to the liquid pulses so that each liquid pulse is impacted by at least one gas pulse. Alternatively, the above described starting and stopping of the electric drive and timing means, 31, can be coordinated with the motion of the liquid pump plunger, 1, by use of switches or other sensors, actuated by the motion of the pump plunger, 1, or other mechanical linkage connecting thereto, and acting as input to the driver, 31.

An application of an atomizer of this invention to a small piston diameter diesel engine is shown schematically in FIG. 13 wherein only the piston, 99, cylinder, 100, and the wrist pin, 101, portions of the internal combustion engine mechanism are shown. A crossed pulse liquid atomizer is used as the engine fuel injector and one atomizer is mounted in each engine cylinder head so as to inject atomized liquid fuel into the engine combustion chamber, 102, late during the compression stroke of the engine cycle. The crossed pulse liquid atomizer shown in FIG. 13 comprises at least one liquid pulser, 103, with liquid fuel supply pipe, 104, at least one gas pulser, 105, and a gas pulse reflector cavity, 106, with return flow passages, 107. The drive and timing means, 108, for the liquid pulsers and the gas pulsers can be any mechanical and/or electrical or other drive means such as those described hereinabove. Because the injected liquid fuel pulses are quickly and finely atomized by the crossed impacts of the gas pulses, low liquid fuel injection pressures can be used with a short penetration distance into the engine combustion chamber, 102, even when high viscosity and residual type fuels are used in this small piston diameter diesel engine. This is one of the beneficial objects achievable with the devices of this invention to utilize high viscosity and residual fuels efficiently in diesel engines of a small piston diameter. For these diesel engine applications, it is essential for obtaining best engine efficiency that fuel injection and atomization be timed to occur only during the last portion of the compression stroke of each engine cycle. This timing requirement can be met in various ways, as by driving a mechanical pulser drive and timing means, 108, directly from the engine camshaft for four stroke cycle engines or the engine crankshaft for two stroke cycle engines. Where an electrical pulser drive and timing means is to be used, an electric or magnetic timing pulse can be taken from a camshaft or crankshaft driven component and used as an input to the drive means to assure proper fuel injection timing.

Many high viscosity and residual fuels are of very low cetane number and thus compression ignite only after a long time delay when used in a diesel engine. When such low cetane fuels are used in high-speed diesel engines, combustion may become inefficiently late during expansion and in extreme case incomplete combustion can occur. Additionally, it becomes difficult to cold start a diesel engine with such low cetane fuels. These problems of low cetane fuels can be resolved by use of a cross-pulsed liquid atomizer equipped with two liquid pulsers, one of which injects several pulses of the low cetane fuel per engine cycle and the other of which injects several pulses of a separate higher cetane fuel per engine cycle. Preferably these several pulses of different fuels are impacted by separate gas pulses so that regions of high cetane fuel are placed in amongst, but not mixed with, other regions of low cetane fuel. Hence, two or more gas pulsers may be used with these two separate liquid pulsers. The high cetane fuel regions will compression ignite quickly and their burning will lead to quicker ignition of the low cetane fuel region. In this way properly timed and efficient burning of the engine fuel can be obtained. Except when cold starting an engine, only small portions of the expensive high-cetane fuel need be used with large portions of the inexpensive low-cetane fuel.

Commonly we desire to fit the atomized cloud of liquid fuel droplets to the diesel engine combustion chamber so as to achieve maximum use of the available compressed air for fuel combustion. Some latitude for this fitting to the spray cloud is available in the shaping of the combustion chamber, but fairly simple combustion chamber shape is preferable as minimizing thermal expansion stresses and cooling jacket heat transfer losses. It is thus preferred to fit the spray cloud shape to a fairly simple combustion chamber shape. By using several gas pulsers placed angularly about the liquid pulse trajectory centerline, a crossed pulse liquid atomizer can be created whose resultant spray cloud can be fitted readily to a simple combustion chamber shape. As an example, four gas pulsers could be positioned about ninety degrees apart around a single liquid pulser whose liquid pulse trajectory centerline was approximately coincident with the engine cylinder centerline. The resultant spray cloud could be made approximately symmetrical about the cylinder centerline if the liquid pulser created a number of pulses for each engine cycle which was a multiple of four. Each succeeding liquid pulse could then be impacted by successive gas pulses separated ninety degrees apart, thus producing a nearly symmetrical spray cloud. Increasing the gas pulses velocity and pressure would increase the spray cloud width at right angles to the cylinder centerline. Decreasing the liquid pulse velocity would decrease the spray cloud depth along the cylinder centerline. In these ways the spray cloud shape could be adjusted to fit a fairly simple combustion chamber shape. The crossed pulse liquid atomizer of FIG. 11, equipped with the four gas pulsers at ninety degrees about the liquid pulse trajectory centerline, 15, could be used for this application. The combustion chamber shape could be further simplified by using a gas pulse reflector means having only a single stepped segment, 91, or by not using a gas pulse reflector means.

When diesel engine torque is to be varied, the total liquid fuel quantity to be injected into each engine cylinder for each engine cycle is varied. This liquid fuel quantity variation can be accomplished by varying the liquid fuel quantity in each pulse, by varying the number of liquid pulses per engine cycle or by a combination of these variations. So that fine atomization of the liquid fuel will always be obtained, we prefer to vary the number of pulses of liquid fuel injected into each engine cycle and retain a roughly constant size of the individual liquid pulses. Hence, as engine torque increases, the number of liquid pulses per engine cycle preferably also increases, with at least two separate pulses being the minimum.

An application of an atomizer of this invention to a burner, such as a gas turbine engine burner, is shown schematically in FIG. 14 wherein only the combustion chamber, 109, with combustion air supply ports, 110, portions are shown. A crossed pulse liquid atomizer is used as the burner fuel atomizer and is mounted on the combustion chamber so as to spray atomized liquid fuel into the combustion chamber, 109, and into the path of the incoming combustion air. The crossed pulse liquid atomizer shown in FIG. 14 comprises at least one liquid pulser, 111, with liquid fuel supply pipe, 112, at least one gas pulser, 113, a gas pulse reflector cavity, 114, with return flow passages, 115, and a gas and liquid pulsers drive and timing means, 116. Because the liquid fuel pulses are quickly and finely atomized by the crossed impacts of the gas pulses, the liquid penetration distance into the combustion chamber, 109, is small and small diameter combustion chambers can be used of a short length. This is one of the beneficial objects achievable with the devices of this invention, that efficient burning of high viscosity fuels can be carried out in small sized combustion chambers.

Burner combustion can be steady or pulsed. For steady combustion, the liquid fuel pulser, 111, furnishes a steady supply of liquid pulses and the fuel burning rate can then be adjusted by adjusting the fuel quantity in each liquid pulse, or by adjusting the number of liquid pulses per unit of time, or by adjusting both. For pulsed combustion, the liquid fuel pulser furnishes a pulse or a group of pulses of liquid fuel into each pulse of combustion air and hence for each combustion cycle. These liquid fuel pulses are delivered into the combustion chamber, 109, concurrently with delivery of the combustion air and the pulser drive and timing means, 116, is thus to be also timed relative to this pulsed delivery of combustion air to each combustion cycle. The fuel burning rate for pulsed combustion chambers can then be adjusted by adjusting the fuel quantity in each liquid pulse, or by adjusting the number of liquid pulses in each group of pulses sprayed into each combustion air pulse, or by adjusting the number of combustion air pulses and hence combustion cycles per unit of time, or by combinations of these methods.

The crossed pulse liquid atomizers of this invention can also be used in spray applications other than combustion, such as for spray drying of liquid solutions and liquid-solid slurries.

Having thus described my invention, what I claim is:

1. A steady liquid fuel burner comprising:

a combustion chamber;

at least one means for creating more than one liquid pulse and for directing each said liquid pulse to travel along a trajectory; said liquid pulser means comprising; means for controlling the quantity of liquid in each liquid pulse, and means for controlling the number of liquid pulses per unit of time;

at least one means for creating more than one gas pulse and for directing each said gas pulse to travel along a trajectory whose centerline intersects the centerline of at least one of said liquid pulse trajectories at an angle of approximately ninety degrees, said gas pulser means comprising means for controlling the number of gas pulses per unit of time;

means for fastening at least one liquid pulser means to said combustion chamber so that all liquid pulses created by all said liquid pulser means travel along trajectories within said combustion chamber;

means for fastening at least one gas pulser means to said combustion chamber so that all gas pulses created by all said gas pulser means travel along trajectories within said combustion chamber;

means for driving and timing said liquid pulser means and said gas pulser means so that each of said liquid pulses is impacted while traveling along said liquid pulse trajectory by at least one of said gas pulses while traveling along said gas pulse trajectories.

2. A steady liquid fuel burner as described in claim 1, and further comprising:

a cavity means for reflecting said gas pulses comprising solid gas pulse reflector surfaces which partially enclose the cavity of said cavity means so that, each of said gas pulses impacts liquid pulses at least twice and each of said liquid pulses is impacted by gas pulses at least twice and so that liquid pulses do not strike said reflector surfaces.

3. A pulsed liquid fuel burner comprising:

a combustion chamber comprising means for delivering combustion air in pulses;

at least one means for creating more than one liquid pulse and for directing each said liquid pulse to travel along a trajectory, said liquid pulser means comprising, means for controlling the quantity of liquid in each liquid pulse, and means for controlling the number of liquid pulses per combustion air pulse;

at least one means for creating more than one gas pulse and for directing each said gas pulse to travel along a trajectory whose centerline intersects the centerline of at least one of said liquid pulse trajectories at an angle of approximately ninety degrees, said gas pulser means comprising means for controlling the number of gas pulses per combustion air pulse;

means for fastening at least one liquid pulser means to said combustion chamber so that all liquid pulses created by all said liquid pulser means travel along trajectories within said combustion chamber;

means for fastening at least one gas pulser means to said combustion chamber so that all gas pulses created by all said gas pulser means travel along trajectories within said combustion chamber;

means for driving and timing said liquid pulser means and said gas pulser means so that, each of said liquid pulses is impacted while traveling along said liquid pulse trajectory by at least one of said gas pulses while traveling along said gas pulse trajectories, more than one liquid pulse is created for each combustion air pulse in said combustion chamber, all liquid pulses for any one combustion air pulse are timed to be delivered into said combustion air pulse.

4. A pulsed liquid fuel burner as described in claim 3, and further comprising:

a cavity means for reflecting said gas pulses comprising solid gas pulse reflector surfaces which partially enclose the cavity of said cavity means so that, each of said gas pulses impacts liquid pulses at least twice and each of said liquid pulses is impacted by gas pulses at least twice and so that liquid pulses do not strike said reflector surfaces.

5. A liquid fuel burner as described in claim 2;

wherein said reflector surfaces of said cavity means are concave, when viewed from the centerline of any said liquid pulse trajectory, within a plane which contains the centerline of said liquid pulse trajectory.

6. A liquid fuel burner as described in claim 2;

wherein said reflector surfaces of said cavity means are concave, when viewed from the centerline of any said liquid pulse trajectory, within a plane which is normal to the centerline of said liquid pulse trajectory.

7. A liquid fuel burner as described in claim 2;

wherein said reflector surfaces of said cavity means comprise a group of stepped segments comprising at least one stepped segment;

and further comprising;

means for positioning said stepped segments of said reflector around the liquid pulse trajectories centerlines at a distance from said centerlines, so that said distance along any line normal to any said centerline is finite and greater than zero to all said reflector surfaces intersected by said normal line, and so that for each single said segment said distances along a series of lines normal to any one centerline and lying within a plane containing said centerline decrease in the direction of principal motion of said liquid pulses along said centerline to all said segment reflector surfaces intersected by said normal lines.

8. A liquid fuel burner as described in claim 4;

wherein said reflector surfaces of said cavity means are concave, when viewed from the centerline of any said liquid pulse trajectory, within a plane which contains the centerline of said liquid pulse trajectory.

9. A liquid fuel burner as described in claim 4;

wherein said reflector surfaces of said cavity means are concave, when viewed from the centerline of any said liquid pulse trajectory, within a plane which is normal to the centerline of said liquid pulse trajectory.

10. A liquid fuel burner as described in claim 4:

wherein said reflector surfaces of said cavity means comprise a group of stepped segments comprising at least one stepped segment;

and further comprising;

means for positioning said stepped segments of said reflector around the liquid pulse trajectories centerlines at a distance from said centerlines, so that said distance along any line normal to any said centerline is finite and greater than zero to all said reflector surfaces intersected by said normal line, and so that for each single said segment said distances along a series of lines normal to any one centerline and lying within a plane containing said centerline decrease in the direction of principal motion of said liquid pulses along said centerline to all said segment reflector surfaces intersected by said normal lines.

11. A liquid fuel burner as described in claim 1, 2, 3, or 4 wherein:

said liquid pulse means increases the number of liquid pulses per unit of time when burner fuel flow rate is to be increased;

said gas pulser means increases the number of gas pulses per unit of time when the number of liquid pulses per unit of time is increased.

* * * * *